US011501644B2

(12) United States Patent
Wang et al.

(10) Patent No.: US 11,501,644 B2
(45) Date of Patent: Nov. 15, 2022

(54) SIGNAL REDUNDANCY CONTROL SYSTEM AND METHOD USED FOR TURNOUT SYSTEM AND COMPUTER READABLE STORAGE MEDIUM

(71) Applicant: BYD COMPANY LIMITED, Shenzhen (CN)

(72) Inventors: Hongtao Wang, Shenzhen (CN); Yun Chen, Shenzhen (CN); Jianbo Wu, Shenzhen (CN); Yue Fang, Shenzhen (CN); Peng He, Shenzhen (CN); Xianhua Liu, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 594 days.

(21) Appl. No.: 16/475,001

(22) PCT Filed: Dec. 26, 2017

(86) PCT No.: PCT/CN2017/118530
§ 371 (c)(1),
(2) Date: Jun. 28, 2019

(87) PCT Pub. No.: WO2018/121505
PCT Pub. Date: Jul. 5, 2018

(65) Prior Publication Data

US 2019/0340930 A1 Nov. 7, 2019

(30) Foreign Application Priority Data

Dec. 30, 2016 (CN) ..... 201611263061.2

(51) Int. Cl.
*G08G 1/00* (2006.01)
*B61D 15/08* (2006.01)
(Continued)

(52) U.S. Cl.
CPC ..... *G08G 1/207* (2013.01); *B61D 15/08* (2013.01); *B61L 23/005* (2013.01);
(Continued)

(58) Field of Classification Search
CPC ..... G08G 1/207; B61D 15/08; B61L 23/005; B61L 25/023; B61L 25/028; B61L 25/04
See application file for complete search history.

(56) References Cited

U.S. PATENT DOCUMENTS 9,162,691 B2 * 10/2015 Polivka ..... B61L 3/243
2005/0076716 A1 * 4/2005 Turner ..... B61L 23/041 73/579
2014/0131524 A1 * 5/2014 Grimm ..... B61L 15/0072 246/3

FOREIGN PATENT DOCUMENTS

CN 2447248 Y 9/2001
CN 101973288 A 2/2011
(Continued)

OTHER PUBLICATIONS

The World Intellectual Property Organization (WIPO) International Search Report for PCT/CN2017/118530 dated Feb. 14, 2018 7 Pages.

*Primary Examiner* — Peter D Nolan
*Assistant Examiner* — Demetra R Smith-Stewart
(74) *Attorney, Agent, or Firm* — Anova Law Group, PLLC

(57) ABSTRACT

The invention provides a signal redundancy control system. The system includes multiple first signal collecting devices, second signal collecting devices and a controller, wherein the multiple first signal collecting devices are configured to collect the dynamic information of default devices where the first signal collecting devices are located in real time; one second signal collecting device corresponding to each of the first signal collecting devices is disposed on each default
(Continued)

device, and is configured to collect the dynamic information of the default device where the second signal collecting device is located in real time; the controller is configured to determine whether the first signal collecting devices include fault information or not, and positions each default device according to the dynamic information acquired by the first signal collecting devices or the second signal collecting devices.

18 Claims, 3 Drawing Sheets

(51) Int. Cl.

| | |
|---|---|
| ***B61L 23/00*** | (2006.01) |
| ***B61L 25/04*** | (2006.01) |
| ***B61L 25/02*** | (2006.01) |

(52) U.S. Cl.
CPC ..... *B61L 25/023* (2013.01); *B61L 25/028* (2013.01); *B61L 25/04* (2013.01)

(56) References Cited

FOREIGN PATENT DOCUMENTS

| | | | | | |
|---|---|---|---|---|---|
| CN | 201825067 | U | | 5/2011 | |
| CN | 105235715 | A | | 1/2016 | |
| CN | 205022608 | U | | 2/2016 | |
| CN | 106004933 | A | * | 10/2016 | ..... B61L 27/04 |
| CN | 106125544 | A | | 11/2016 | |
| CN | 106794853 | A | * | 5/2017 | ..... B61L 15/0027 |
| CN | 106864485 | A | * | 6/2017 | |
| CN | 206704212 | U | * | 12/2017 | |
| DE | 102016111098 | A1 | * | 12/2017 | ..... B61L 15/0027 |
| JP | H0853065 | A | | 2/1996 | |

* cited by examiner

SIGNAL REDUNDANCY CONTROL SYSTEM AND METHOD USED FOR TURNOUT SYSTEM AND COMPUTER READABLE STORAGE MEDIUM

CROSS-REFERENCE TO RELATED APPLICATIONS

This application is a national phase entry under 35 U.S.C. § 371 of International Application No. PCT/CN2017/118530, filed on Dec. 26, 2017, which claims priority to China Patent Application No. 2016112630612, filed on Dec. 30, 2016, content of all of which is incorporated herein by reference in its entirety.

FIELD

The present invention relates to the technical field of traffic track and, particularly relates to a signal redundancy control system and method used for a turnout system and a computer readable storage medium.

BACKGROUND

In the technical field of railway traffic, according to the working principle of a turnout system of a train track, the turnout open direction is driven by controlling the synchronous movement of a plurality of driving devices under a turnout beam in the turnout system, and pulse signals generated by the plurality of driving devices in movement present certain regular features.

SUMMARY

An objective of the present disclosure is to at least resolve one of the technical problems in the related art to some extent.

Therefore, an objective of the present disclosure is to provide a signal redundancy control system used for a turnout system, which is capable of implementing redundancy control on collected signals of a plurality of drive equipment in the turnout system, so as to promote the signal positioning accuracy in the turnout system and effectively promote the signal control reliability of the turnout system.

Another objective of the present disclosure is to provide a signal redundancy control method used for a turnout system.

Another objective to the present disclosure is to provide a computer readable storage medium.

In order to achieve the foregoing objectives, the embodiment of the first aspect of the present disclosure provides a signal redundancy control system used for a turnout system, including: a plurality of first signal collecting devices, second signal collecting devices and a controller, wherein each of the first signal collecting devices is disposed on a default device in the turnout system, and each of the first signal collecting devices is configured to collect the dynamic information of the default device where the first signal collecting device is located in real time; a second signal collecting device corresponding to each of the first signal collecting devices is disposed on each default device, wherein each second signal collecting device is configured to collecting the dynamic information of the default device where the second signal collecting device is located in real time, and mutual redundancy exists between the first signal collecting device and the second signal collecting device disposed on the same default device; the controller is configured to acquire the dynamic information, collected by each of the first signal collecting devices, of the default device where the first signal collecting device is located, and determining whether the first signal collecting device includes fault information or not according to the dynamic information, and when it is determined that the fault information exists, the controller acquires the dynamic information collected by the second signal collecting device corresponding to the first signal collecting device generating fault to replace the dynamic information acquired by the first signal collecting device generating fault, and positions each default device according to the dynamic information acquired by the first signal collecting device or the second signal collecting device, wherein the type of each default device is the same, and the mounting position of each default device in the turnout system is different.

The embodiment of the first aspect of the present disclosure provides a signal redundancy control system used for a turnout system, wherein each of the first signal collecting devices collects the dynamic information of the default device where the first signal collecting device is located in real time; a second signal collecting device corresponding to the first signal collecting device is disposed on each default device, and mutual redundancy exists between the first signal collecting device and the second signal collecting device disposed on the same default device; the controller acquires the dynamic information, collected by each of the first signal collecting devices, of the default device where the first signal collecting device is located and judges whether the first signal collecting device includes fault information or not according to the dynamic information, and when it is determined that the fault information exists, the controller acquires the dynamic information collected by the second signal collecting device corresponding to the first signal collecting device generating fault to replace the dynamic information acquired by the first signal collecting device generating fault, and positions each default device according to the dynamic information acquired by the first signal collecting device or the second signal collecting device, wherein the type of each default device is the same, and the mounting position of each default device in the turnout system is different, and therefore, redundancy control is performed on collected signals of a plurality of driving devices in the turnout system, the signal positioning accuracy in the turnout system is promoted, and the signal control reliability of the turnout system is effectively promoted.

In order to achieve the foregoing objectives, the embodiment of the second aspect of the present disclosure provides a signal redundancy control method used for a turnout system, including: acquiring the dynamic information, collected by each of the first signal collecting devices, of the default device where the first signal collecting device is located, and determining whether the first signal collecting device includes fault information or not according to the dynamic information; when it is determined that the default information exists, acquiring the dynamic information collected by the second signal collecting device corresponding to the first signal collecting device generating fault, to replace the dynamic information acquired by the first signal collecting device generating fault; and positioning each default device according to the dynamic information acquired by the first signal collecting device or the second signal collecting device, wherein each default device is provided with one first signal collecting device and the second signal collecting device corresponding to the first signal collecting device, the first signal collecting device and the second signal collecting device are both configured to collect the dynamic information of the default device where the first signal collecting device and the second signal collecting device are located in real time, mutual redundancy exists between the first signal collecting device and the second signal collecting device disposed on the same default device, the type of each default device is the same, and the mounting position of each default device in the turnout system is different.

The embodiment of the second aspect of the present disclosure provides a signal redundancy control method used for a turnout system, including: acquiring the dynamic information, collected by each of the first signal collecting devices, of the default device where the first signal collecting device is located, and determining whether the first signal collecting device includes fault information or not according to the dynamic information; when it is determined that the default information exists, acquiring the dynamic information collected by the second signal collecting device corresponding to the first signal collecting device generating fault, to replace the dynamic information acquired by the first signal collecting device generating fault; and positioning each default device according to the dynamic information acquired by the first signal collecting device or the second signal collecting device, wherein each default device is provided with one first signal collecting device and a second signal collecting device corresponding to the first signal collecting device, the first signal collecting device and the second signal collecting device are both configured to collect the dynamic information of the default device where the first signal collecting device and the second signal collecting device are located in real time, mutual redundancy exists between the first signal collecting device and the second signal collecting device disposed on the same default device, the type of each default device is the same, and the mounting position of each default device in the turnout system is different, and therefore, redundancy control is performed on collected signals of a plurality of driving devices in the turnout system, the signal positioning accuracy in the turnout system is promoted, and the signal control reliability of the turnout system is effectively promoted.

In order to achieve the foregoing objectives, the embodiment of the third aspect of the present disclosure provides a computer readable storage medium, including a computer instruction, and when the computer instruction is executed, the signal redundancy control method used for the turnout system is executed.

The additional aspects and advantages of the present disclosure will be provided in the following description, and some of the additional aspects and advantages will become clear in the following description or be understood through practice of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

The following describes in detail embodiments of the present disclosure. Examples of the embodiments are shown in the accompanying drawings, where reference signs that are the same or similar from beginning to end represent same or similar components or components that include same or similar functions. The following embodiments described with reference to the accompanying drawings are exemplary, and are intended to describe the present disclosure and cannot be construed as a limitation to the present disclosure. On the contrary, the embodiments of the present disclosure include all alterations, modifications and equivalents falling within the spirit and connotation scope of the appended claims.

Figure 1:
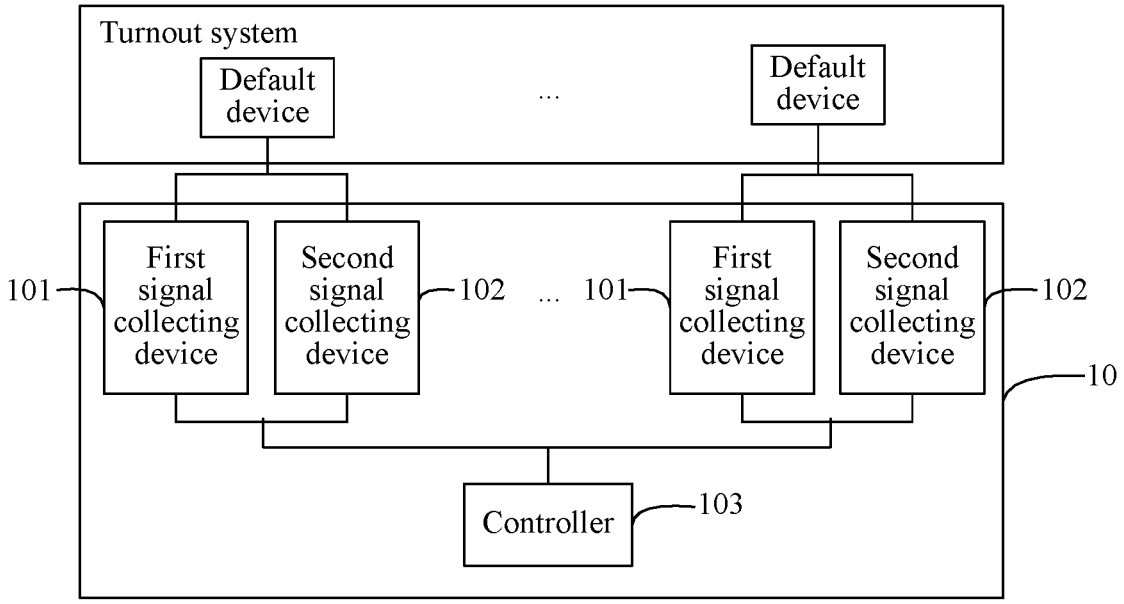
FIG. 1 is a structural schematic diagram of a signal redundancy control system used for a turnout system provided by an embodiment of the present disclosure.

FIG. 1 is a structural schematic diagram of a signal redundancy control system used for a turnout system provided by an embodiment of the present disclosure.

The signal redundancy control system 10 used for the turnout system in the present disclosure realizes redundancy control on the collected signals of the turnout system by setting redundant signal collecting devices for the turnout system in the field of rail traffic.

Specifically, the signal redundancy control system 10 used for the turnout system is configured to perform redundancy control on signals of trolleys in the turnout system, or, of limiting switches on swing arm rotating positions on a turnout beam in the turnout system.

Referring to FIG. 1, the signal redundancy control system 10 used for the turnout system includes: a plurality of first signal collecting devices 101, a plurality of second signal collecting devices 102, and a controller 103.

In an embodiment of the present disclosure, the signal redundancy control system 10 used for the turnout system includes: a plurality of first signal collecting devices 101, each of the first signal collecting devices 101 is disposed on a default device in the turnout system, and each of the first signal collecting devices 101 is configured to collect the dynamic information of the default device where the first signal collecting device is located in real time.

It can be understood that, in the embodiment of the present disclosure, the number of the default devices in the turnout system is the same as the number of the first signal collecting devices 101, and each of the first signal collecting devices 101 is disposed on the default device corresponding to a pulse signal needing to collect dynamic information in the turnout system. In the embodiment of the present disclosure, the signal redundancy control system 10 used for the turnout system includes a plurality of first signal collecting devices 101, wherein the first signal collecting devices 101 are, for example, encoders, and are not limited herein.

The type of each default device is the same, and the mounting position of each default device in the turnout system is different.

For example, when the first signal collecting device 101 is the encoder, the encoder collects the dynamic information of the default device by collecting the pulse signal generated by the movement of the default device where the encoder is located in real time, and the first signal collecting device 101 is not limited herein.

Further, the default devices are, for example, trolleys, or the default devices are, for example, limiting switches on swing arm rotating positions on a turnout beam in the turnout system, or are other a plurality of parallel provided driving devices driving the turnout open direction in the turnout system, and the default devices are not limited herein.

Optionally, when the default devices are the trolleys, the dynamic information is the displacement information of the trolleys.

Optionally, when the default devices are the limiting switches, the dynamic information is the time interval for the limiting switches to send out control signals twice.

In an embodiment of the preset invention, the signal redundancy control system 10 used for the turnout system also includes: a second signal collecting device 102 which is disposed on each default device and corresponding to each of the first signal collecting devices 101, wherein each second signal collecting device is configured to collect the dynamic information of the default device where the second signal collecting device is located in real time, and mutual redundancy exists between the first signal collecting device 101 and the second signal collecting device 102 disposed on the same default device.

It is understandable that, according to the working principle of a turnout system of a train track, the turnout open direction is driven by controlling the synchronous movement of a plurality of driving devices under a turnout beam in the turnout system, and pulse signals generated by the plurality of driving devices in movement present certain regular features. For example, or in a certain predetermined scope, the difference values of the pulse signals are kept consistent. And therefore, in the embodiment of the present disclosure, the first signal collecting device 101 and the second signal collecting device 102 which are in mutual redundancy are disposed on each default device driving the turnout open direction in the turnout system, so as to realize redundancy control on collected signals of a plurality of driving devices in the turnout system, and promote the signal positioning accuracy in the turnout system.

In the embodiment of the present disclosure, the first signal collecting device 101 and the corresponding second signal collecting device 102 are started at the same time at the initial moment, so that the corresponding second signal collecting device 102 collects the dynamic information of the default device where the corresponding second signal collecting device 102 is located in real time, and realizes heat switching when the first signal collecting device 101 includes fault, to realize seamless replacement of the dynamic information, collected by the first signal collecting device 101 in real time, of the default device where the first signal collecting device 101 is located, and realize high-precision redundant control of the signals.

In the embodiment of the present disclosure, the number of the first signal collecting devices 101 is the same as the number of the second signal collecting devices 102.

In an embodiment of the present disclosure, the signal redundancy control system 10 used for the turnout system also includes: a controller 103, wherein the controller 103 is configured to acquire the dynamic information, collected by each of the first signal collecting devices, of the default device where the first signal collecting device 101 is located, and determining whether the first signal collecting device 101 includes fault information or not according to the dynamic information, and when it is determined that the fault information exists, the controller 103 acquires the dynamic information collected by the second signal collecting device 102 corresponding to the first signal collecting device 101 generating fault to replace the dynamic information acquired by the first signal collecting device generating fault, and positions each default device according to the dynamic information acquired by the first signal collecting device 101 or the second signal collecting device 102.

The controller 103 is, for example, a programmable logic controller (PLC).

Figure 2:
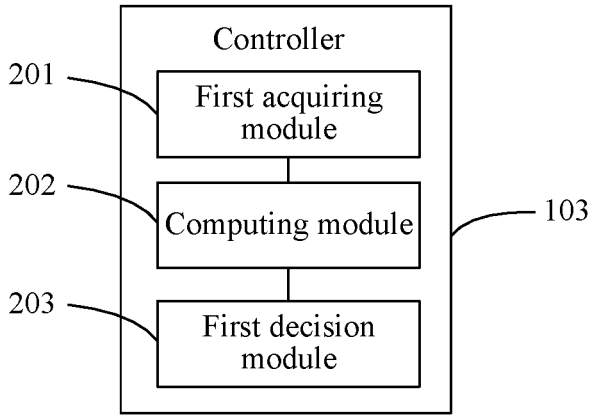
FIG. 2 is a structural schematic diagram of a controller provided by an embodiment of the present disclosure.

Optionally, in some embodiments, referring to FIG. 2, FIG. 2 is a structural schematic diagram of a controller 103 provided by an embodiment of the present disclosure, and when the default devices are the trolleys, the controller 103 includes: a first acquiring module 201, a computing module 202, and a first decision module 203.

In the embodiment as shown in FIG. 2, the signal redundancy control system 10 used for the turnout system performs signal redundancy control on the trolleys in the turnout system.

The first acquiring module 201 is configured to acquire the displacement information, collected by the plurality of first signal collecting devices 101, of the trolleys.

A rectangular coordinate system is established in advance by taking the position coordinate of the trolleys without generating movement as a zero coordinate, while the position after movement is taken as the displacement information based on the relative position coordinate of the zero coordinate in the rectangular coordinate system, or, the corresponding displacement information is determined according to a manner of collecting the pulse signal, and the displacement information is not limited herein.

In the embodiment of the preset invention, the first acquiring module 201 respectively acquires the displacement information, collected by each of the first signal collecting devices 101, of the trolleys from the plurality of first signal collecting devices 101, and further, the acquiring process is the real-time acquiring process.

In the embodiment of the present disclosure, redundancy control is realized on signals of each trolley in the turnout system by acquiring the displacement information of the plurality of trolleys, so as to effectively ensure the signal positioning accuracy of each trolley.

The computing module 202 is configured to compute the comparison information between the displacement information of two adjacent trolleys according to the displacement information.

The comparison information is a difference value or a specific value between the displacement information of two adjacent trolleys, and is not limited herein.

The first decision module 203 is configured to compare the comparison information with a predetermined threshold, and when the comparison information is greater than or equal to the predetermined threshold, and the trolley corresponding to the comparison information exceeding the predetermined threshold is in a normal operation state, determining whether the first signal collecting device 101 disposed on the trolley corresponding to the comparison information exceeding the predetermined threshold includes the fault information or not.

The predetermined threshold is preset, that is, the error value of pulse signals generated by the movement between different trolleys is determined by a manufacturer of the turnout system according to the performance thereof, and the predetermined threshold is pre-configured by referring to the error value, or, the predetermined threshold is configured by a user, and is not limited herein.

The first signal collecting device 101 including fault information is determined by comparing the comparison information between the displacement information of two adjacent trolleys with the predetermined threshold, and redundancy control is timely performed on the signal of each trolley. And because the algorithm is simple and easy to realize, and the reliability is high, computing resource consumed by the signal redundancy control system 10 is saved, and the executing efficiency of the system is promoted.

Figure 3:
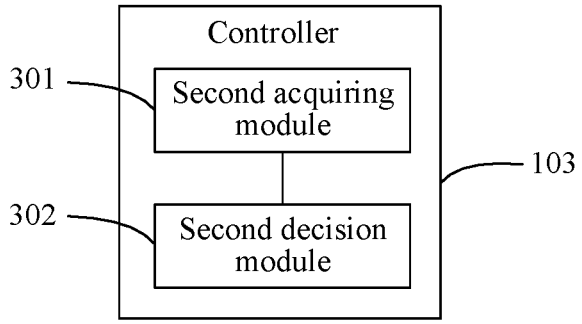
FIG. 3 is a structural schematic diagram of the controller provided by another embodiment of the present disclosure.

Optionally, in some embodiments, referring to FIG. 3, FIG. 3 is a structural schematic diagram of the controller 103 provided by another embodiment of the present disclosure. When the default devices are the limiting switches, the controller 103 includes: a second acquiring module 301 and a second decision module 302.

In the embodiment as shown in FIG. 3, the signal redundancy control system 10 used for the turnout system also performs signal redundancy control on the limiting switches in the turnout system.

The second acquiring module 301 is configured to acquire the time intervals, collected by the plurality of first signal collecting devices 101, for the limiting switches to send out control signals.

It is understandable that, according to the working principle of a turnout system of a train track, limiting switches are provided at swing arm rotating positions on a turnout beam in the turnout system, a gear motor drives swing arms to rotate to drive the turnout beam to move, the swing arms touch the limiting switches in the rotating process, and the limiting switches send out control signals to drive the turnout beam to move, and therefore, redundancy control on the signals of the limiting switches is triggered according to the time interval for each limiting switch to send out the control signal twice.

In the embodiment of the present disclosure, the second acquiring module 301 directly reads the time interval for a plurality of limiting switches to send out the control signals at the first signal collecting devices 101, wherein the time interval is determined by the first signal collecting devices 101 in a manner of collecting the pulse signals, and is not limited herein.

The second decision module 302 is configured to determine whether the time intervals for the plurality of limiting switches to send out control signals are the same or not, and when the time interval for one limiting switch to send out the control signal is different from the time intervals for other limiting switches to send out the control signal in the plurality of switches, and the prior limiting switch is in a normal operation state, determining that the first signal collecting device 101 on the prior limiting switch includes the fault information.

The first signal collecting device 101 on any limiting switch includes the fault information when the time interval for the any limiting switch to send out the control signal is different from the time intervals for other limiting switches to send out the control signal in the plurality of switches, and the any limiting switch is in a normal operation state, and the dynamic information, collected by the second signal collecting device 102 in real time, of the limiting switches is acquired timely, so as to realize redundancy control on the signals of the limiting switches in the turnout system, and promote the signal positioning accuracy of the limiting switches in the turnout system.

Figure 4:
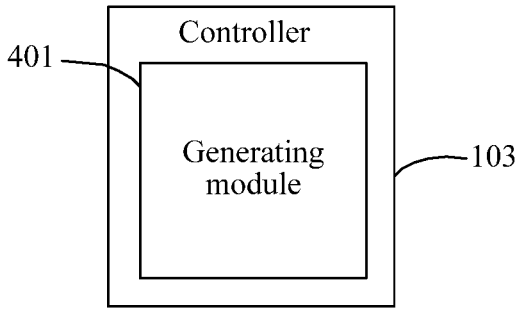
FIG. 4 is a structural schematic diagram of the controller provided by another embodiment of the present disclosure.

Optionally, in some embodiments, referring to FIG. 4, FIG. 4 is a structural schematic diagram of the controller provided by another embodiment of the present disclosure, the controller 103 in any embodiment as shown in FIG. 2 or FIG. 3 also includes: a generating module 401.

The generating module 401 is configured to generate alarm information that the first signal collecting device 101 includes the fault information when start control is performed on a switching motor, so as to prompt the user according to the alarm information.

The alarm information that the first signal collecting device 101 includes the fault information is generated after the first signal collecting device 101 of the turnout system includes the fault information, so as to prompt the user, and then the user timely acquires the fault information to rapidly respond, the use experience degree of the user is promoted, and the intelligent control effect of the signal redundancy control of the turnout system is promoted.

In the present embodiment, each of the first signal collecting devices collects the dynamic information of the default device where the first signal collecting device is located in real time; one second signal collecting device corresponding to the first signal collecting device is disposed on each default device, and mutual redundancy exists between the first signal collecting device and the second signal collecting device disposed on the same default device; the controller acquires the dynamic information, collected by each of the first signal collecting devices, of the default device where the first signal collecting device is located, and judges whether the first signal collecting device includes fault information or not according to the dynamic information, and when it is determined that the fault information exists, the controller acquires the dynamic information collected by the second signal collecting device corresponding to the first signal collecting device generating fault to replace the dynamic information acquired by the first signal collecting device generating fault, and positions each default device according to the dynamic information acquired by the first signal collecting device or the second signal collecting device, wherein the type of each default device is the same, and the mounting position of each default device in the turnout system is different, and therefore, redundancy control is performed on collected signals of a plurality of driving devices in the turnout system, the signal positioning accuracy in the turnout system is promoted, and the signal control reliability of the turnout system is effectively promoted.

Figure 5:
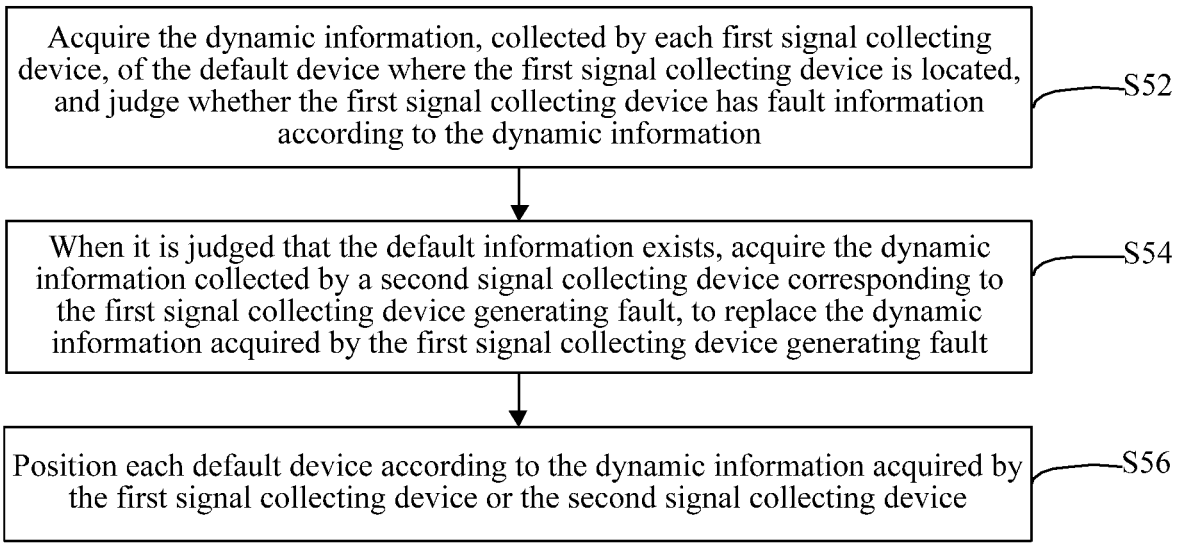
FIG. 5 is a flow schematic diagram of a signal redundancy control method used for a turnout system provided by an embodiment of the present disclosure.

FIG. 5 is a flow schematic diagram of a signal redundancy control method used for a turnout system provided by an embodiment of the present disclosure.

Referring to FIG. 5, the method includes:

S52: the dynamic information, collected by each of the first signal collecting devices, of the default device where the first signal collecting device is located is acquired, and whether the first signal collecting device includes fault information or not is determined according to the dynamic information.

One first signal collecting device is disposed on each default device, and the first signal collecting device is configured to collect the dynamic information of the default device where the first signal collecting device is located in real time.

Optionally, the default devices are trolleys, and when the default devices are the trolleys, the dynamic information is the displacement information of the trolleys.

Optionally, the default devices are limiting switches on swing arm rotating positions on a turnout beam in the turnout system, and when the default devices are the limiting switches, the dynamic information is time intervals for the limiting switches to send out control signals twice.

Figure 6:
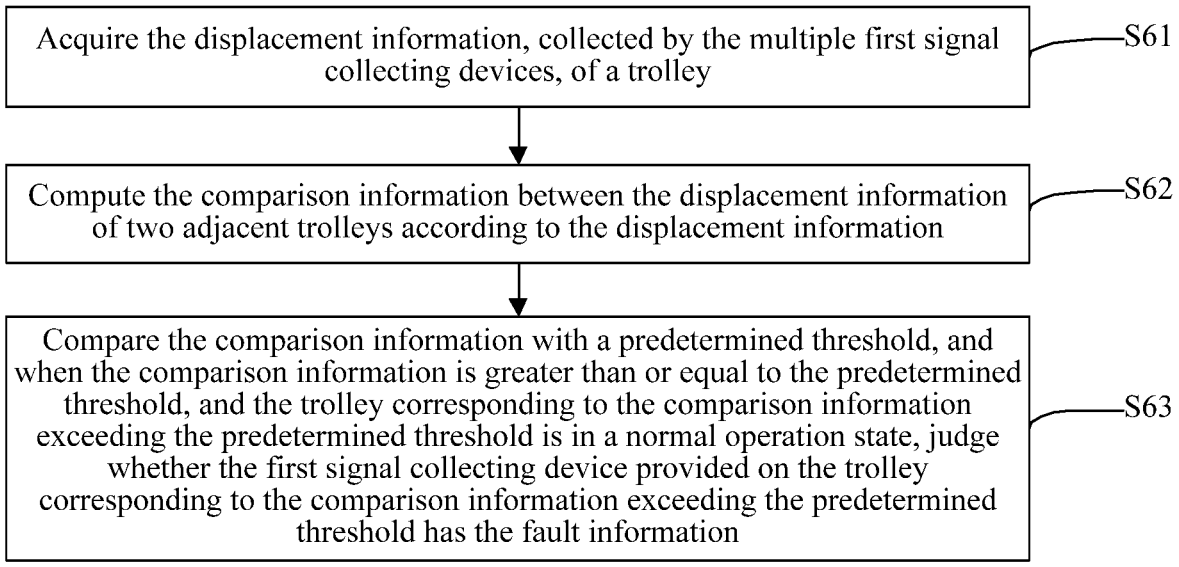
FIG. 6 is a flow schematic diagram of the signal redundancy control method used for the turnout system provided by another embodiment of the present disclosure.

Optionally, in some embodiments, referring to FIG. 6, when the default devices are the trolleys, S52 includes:

S61: the displacement information, collected by the plurality of first signal collecting devices, of the trolley is acquired;

S62: the comparison information between the displacement information of two adjacent trolleys is computed according to the displacement information.

Optionally, the comparison information is a difference value or a specific value between the displacement information of two adjacent trolleys.

S63: the comparison information is compared with a predetermined threshold, and when the comparison information is greater than or equal to the predetermined threshold, and the trolley corresponding to the comparison information exceeding the predetermined threshold is in a normal operation state, whether the first signal collecting device disposed on the trolley corresponding to the comparison information exceeding the predetermined threshold includes the fault information or not is determined.

Figure 7:
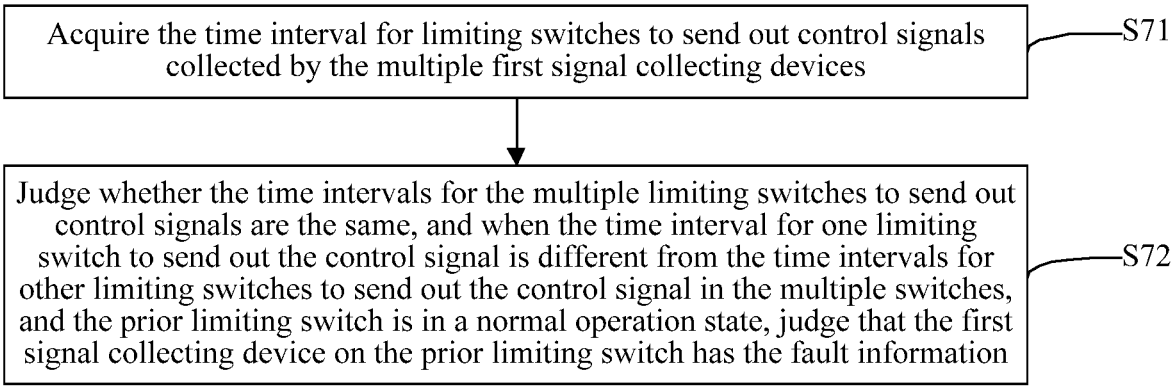
FIG. 7 is a flow schematic diagram of the signal redundancy control method used for the turnout system provided by another embodiment of the present disclosure.

Optionally, in some embodiments, referring to FIG. 7, when the default devices are the limiting switches, S52 includes:

S71: the time interval, collected by the plurality of first signal collecting devices, for the limiting switches to send out control signals is acquired.

S72: whether the time intervals for the plurality of limiting switches to send out control signals are the same or not is determined, and when the time interval for one limiting switch to send out the control signal is different from the time intervals for other limiting switches to send out the control signal in the plurality of switches, and the prior limiting switch is in a normal operation state, a phenomenon that the first signal collecting device on the prior limiting switch includes the fault information is determined.

S54: when it is determined that the default information exists, the dynamic information collected by the second signal collecting device corresponding to the first signal collecting device generating fault is acquired to replace the dynamic information acquired by the first signal collecting device generating fault.

Each default device is provided with one second signal collecting device corresponding to the first signal collecting device, the second signal collecting device is configured to collect the dynamic information of the default device where the second signal collecting device is located in real time, and mutual redundancy exists between the first signal collecting device and the second signal collecting device disposed on the same default device.

S56: each default device is positioned according to the dynamic information acquired by the first signal collecting device or the second signal collecting device.

The type of each default device is the same, and the mounting position of each default device in the turnout system is different.

Figure 8:
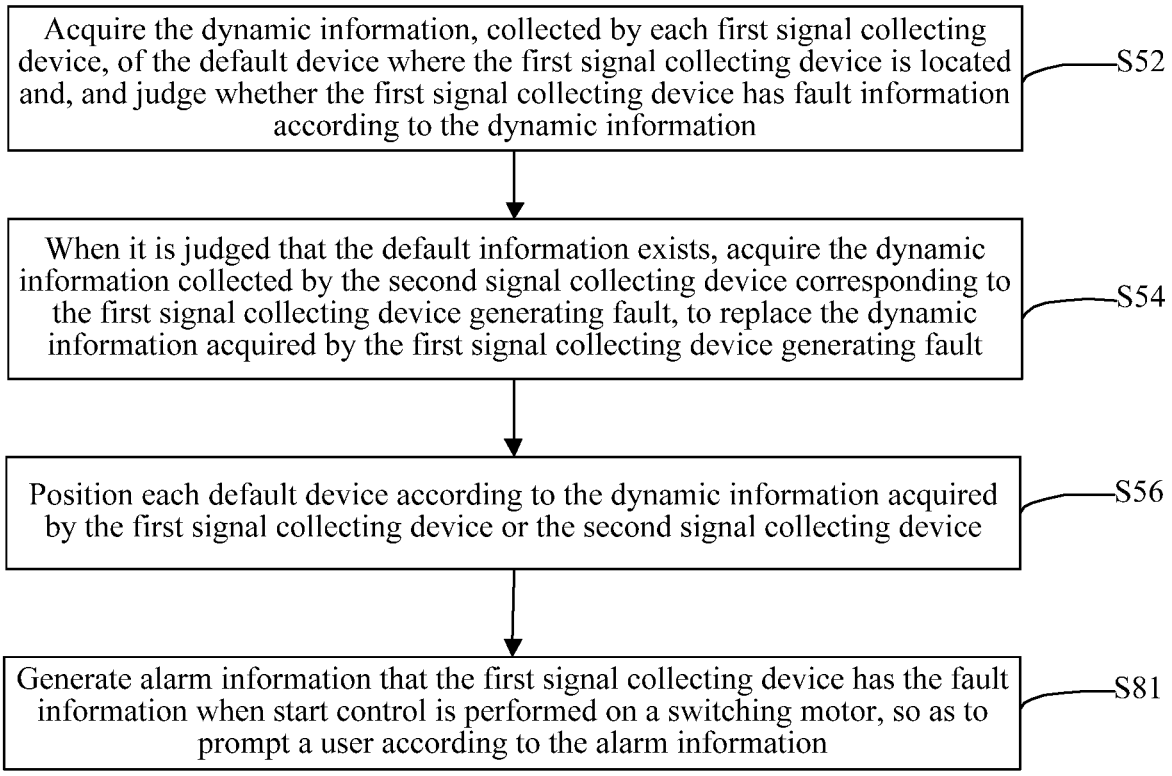
FIG. 8 is a flow schematic diagram of the signal redundancy control method used for the turnout system provided by another embodiment of the present disclosure.

Optionally, in some embodiments, referring to FIG. 8, the method also includes:

S81: alarm information that the first signal collecting device includes the fault information is generated when start control is performed on a switching motor, so as to prompt the user according to the alarm information.

What needs to be illustrated is that, explanations for the embodiments of the signal redundancy control system used for the turnout system in the foregoing embodiments of FIG. 1 to FIG. 4 are also applicable to the signal redundancy control method used for the turnout system in the present embodiment, and the realization principle is similar, and is not further described herein.

In the present embodiment, the dynamic information, collected by each of the first signal collecting devices, of the default device where the first signal collecting device is located is acquired, and whether the first signal collecting device includes fault information or not is determined according to the dynamic information; when it is determined that the fault information exists, the dynamic information collected by the second signal collecting device corresponding to the first signal collecting device generating fault is acquired to replace the dynamic information acquired by the first signal collecting device generating fault; and each default device is positioned according to the dynamic information acquired by the first signal collecting device or the second signal collecting device, wherein each default device is provided with one first signal collecting device and the second signal collecting device corresponding to the first signal collecting device, both the first signal collecting device and the second signal collecting device are configured to collect the dynamic information of the default device where first signal collecting device and the second signal collecting device are located in real time, mutual redundancy exists between the first signal collecting device and the second signal collecting device disposed on the same default device, the type of each default device is the same, and the mounting position of each default device in the turnout system is different, and therefore, redundancy control is performed on collected signals of a plurality of driving devices in the turnout system, the signal positioning accuracy in the turnout system is promoted, and the signal control reliability of the turnout system is effectively promoted.

What needs to be illustrated is that, in the descriptions of the present disclosure, terms "first", "second" and the like are only configured to describe instead of being understood as indicating or hinting relative importance. Moreover, in the descriptions of the present disclosure, unless otherwise noted, the meaning of "a plurality of" is two or more.

Any process or method in the flow diagram or described in other manners herein should be understood by representing modules, fragments or parts including one or more codes of executable instructions configured to realize specific logic functions or processes. Moreover, the scope of the preferred implementation mode of the present disclosure includes additional implementation, wherein the function is executed without abiding by the shown or discussed sequence, including a manner basically at the same time or a reverse sequence according to the involved function, and it should be understood by persons skilled in the art to which the embodiments of the present disclosure belong.

It should be understood that, all parts of the present disclosure are realized by hardware, software, firmware or combinations thereof. In the foregoing implementation manners, a plurality of steps or methods are realized by software or firmware which is stored in a memory and executed by a proper instruction execution system. For example, if being realized by using the hardware, like that in another implementation mode, the plurality of steps or methods are realized by any one of the following technologies or combinations thereof: a discrete logic circuit including a logic gate circuit configured to realize a logic function on a data signal, an application-specific integrated circuit including a proper combined logic gate circuit, a programmable gate array (PGA), a field programmable gate array (FPGA) and the like.

A person of ordinary skill in the art understands that all or some of the steps of the foregoing embodiments are implemented by a program instructing relevant hardware. The program is stored in a computer readable storage medium, and when the program is executed, one of steps or combination thereof of the embodiments of the method is included.

In addition, the functional units in the embodiments of the present disclosure are integrated into one processing module, or each unit exists alone physically, or two or more units are integrated into one module. The integrated module is implemented in the form of hardware, or is implemented in the form of a software functional module. The integrated module is also stored in a computer readable storage medium if implemented in the form of the software functional module and sold or used as an independent product.

The storage medium is a read-only memory, a magnetic disk, a disc, or the like.

In the description of the specification, the description made with reference to terms such as "one embodiment", "some embodiments", "example", "specific example", or "some examples" means that a specific characteristic, structure, material or feature described with reference to the embodiment or example is included in at least one embodiment or example of the present disclosure. In this specification, exemplary descriptions of the foregoing terms do not necessarily refer to a same embodiment or example. In addition, the described specific features, structures, materials, or characteristics may be combined in an appropriate manner in any one or a plurality of embodiments or examples.

Although the embodiments of the present disclosure are shown and described above, it can be understood that, the foregoing embodiments are exemplary, and cannot be construed as a limitation to the present disclosure. Within the scope of the present disclosure, a person of ordinary skill in the art may make changes, modifications, replacement, and variations to the foregoing embodiments.

What is claimed is:

1. A signal redundancy control system of a turnout system, comprising:

a plurality of first signal collecting devices, wherein each of a plurality of first signal collecting devices is disposed on each of a plurality of default devices in the turnout system, and each of the first signal collecting devices is configured to collect the dynamic information of the default device where the first signal collecting device is located in real time;

second signal collecting devices corresponding to the first signal collecting devices and disposed on the default devices, wherein each second signal collecting device is configured to collect the dynamic information of the default device where the second signal collecting device is located in real time, and mutual redundancy exists between the first signal collecting device and the second signal collecting device disposed on the same default device; and a controller, wherein the controller is configured to acquire the dynamic information, which is collected by each of the first signal collecting devices, of the default device where the first signal collecting device is located, and determining whether the first signal collecting devices include fault information or not according to the dynamic information, and when it is determined that the fault information exists, the controller acquires the dynamic information collected by the second signal collecting device corresponding to the first signal collecting device generating fault to replace the dynamic information acquired by the first signal collecting device generating fault, and positions each default device according to the dynamic information acquired by the first signal collecting devices or the second signal collecting devices, wherein the type of each default device is the same, and the mounting position of each default device in the turnout system is different.

2. The signal redundancy control system of the turnout system according to claim 1, wherein the default devices are trolleys, and when the default devices are the trolleys, the dynamic information is the displacement information of the trolleys.

3. The signal redundancy control system of the turnout system according to claim 2, wherein when the default devices are the trolleys, the controller comprises:

a first acquiring module, configured to acquire the displacement information, collected by the plurality of first signal collecting devices, of the trolleys;

a computing module, configured to compute comparison information between the displacement information of two adjacent trolleys according to the displacement information;

a first decision module, configured to compare the comparison information with a predetermined threshold, and when the comparison information is greater than or equal to the predetermined threshold, and the trolley corresponding to the comparison information exceeding the predetermined threshold is in a normal operation state, determining whether the first signal collecting device disposed on the trolley corresponding to the comparison information exceeding the predetermined threshold includes the fault information or not.

4. The signal redundancy control system of the turnout system according to claim 3, wherein the comparison information is a difference value or a specific value between the displacement information of two adjacent trolleys.

5. The signal redundancy control system of the turnout system according to claim 1, wherein the default devices are limiting switches on swing arm rotating positions on a turnout beam in the turnout system, and when the default devices are the limiting switches, the dynamic information is time intervals for the limiting switches to send out control signals twice.

6. The signal redundancy control system of the turnout system according to claim 5, wherein when the default devices are the limiting switches, the controller comprises:

a second acquiring module, configured to acquire the time intervals, collected by the plurality of first signal collecting devices, for the limiting switches to send out control signals; and a second decision module, configured to determine whether the time intervals of the plurality of limiting switches are the same or not, and when the time interval for one limiting switch to send out the control signal is different from the time intervals for other limiting switches to send out the control signal in the plurality of switches, and the prior limiting switch is in a normal operation state, determining that the first signal collecting device on the prior limiting switch includes the fault information.

7. The signal redundancy control system of the turnout system according to claim 3, wherein the controller also comprises:

a generating module, configured to generate alarm information that the first signal collecting device includes the fault information when start control is performed on a switching motor, so as to prompt a user according to the alarm information.

8. A signal redundancy control method of a turnout system, comprising:

acquiring the dynamic information, collected by each of a plurality of first signal collecting devices, of each of a plurality of default devices where the first signal collecting device is located, and determining whether the first signal collecting device includes fault information or not according to the dynamic information;

when it is determined that the default information exists, acquiring the dynamic information collected by a second signal collecting device corresponding to the first signal collecting device generating fault, to replace the dynamic information acquired by the first signal collecting device generating fault; and positioning each default device according to the dynamic information acquired by the first signal collecting device or the second signal collecting device;

wherein each default device is provided with one first signal collecting device and the second signal collecting device corresponding to the first signal collecting device, the first signal collecting device and the second signal collecting device are both configured to collect the dynamic information of the default device where the first signal collecting device and the second signal collecting device are located in real time, mutual redundancy exists between the first signal collecting device and the second signal collecting device disposed on the same default device, the type of each default device is the same, and the mounting position of each default device in the turnout system is different.

9. The signal redundancy control method of the turnout system according to claim 8, wherein the default devices are trolleys, and when the default devices are the trolleys, the dynamic information is the displacement information of the trolleys.

10. The signal redundancy control method of the turnout system according to claim 9, wherein when the default devices are the trolleys, the acquiring the dynamic information, collected by each of the first signal collecting devices, of each of the default devices where the first signal collecting devices are located, and determining whether the first signal collecting devices include fault information or not according to the dynamic information comprises:

acquiring the displacement information, collected by the plurality of first signal collecting device, of the trolleys;

computing comparison information between the displacement information of two adjacent trolleys according to the displacement information; and comparing the comparison information with a predetermined threshold, and when the comparison information is greater than or equal to the predetermined threshold, and the trolley corresponding to the comparison information exceeding the predetermined threshold is in a normal operation state, determining whether the first signal collecting device disposed on the trolley corresponding to the comparison information exceeding the predetermined threshold includes the fault information or not.

11. The signal redundancy control method of the turnout system according to claim 10, wherein the comparison information is a difference value or a specific value between the displacement information of two adjacent trolleys.

12. The signal redundancy control method of the turnout system according to claim 8, wherein the default devices are limiting switches on swing arm rotating positions on a turnout beam in the turnout system, and when the default devices are the limiting switches, the dynamic information is time intervals for the limiting switches to send out control signals twice.

13. The signal redundancy control method of the turnout system according to claim 12, wherein when the default devices are the limiting switches, the acquiring the dynamic information, collected by each of the first signal collecting devices, of the default device where the first signal collecting device is located, and determining whether the first signal collecting device includes fault information or not according to the dynamic information comprises:

acquiring the time intervals, collected by the plurality of first signal collecting devices, for the limiting switches to send out control signals; and determining whether the time intervals of the plurality of limiting switches are the same or not, and when the time interval for one limiting switch to send out the control signal is different from the time intervals for other limiting switches to send out the control signal in the plurality of switches, and the prior limiting switch is in a normal operation state, determining that the first signal collecting device on the prior limiting switch comprises the fault information.

14. The signal redundancy control method of the turnout system according to claim 10, wherein the method also comprises:

generating alarm information that the first signal collecting device includes the fault information when start control is performed on a switching motor, so as to prompt a user according to the alarm information.

15. A non-transitional computer readable storage medium, comprising computer instructions for, when executed by one or more processor, performing a signal redundancy control method of a turnout system comprising:

acquiring the dynamic information, collected by each of a plurality of first signal collecting devices, of each of a plurality of default devices where the first signal collecting device is located, and determining whether the first signal collecting device includes fault information or not according to the dynamic information;

when it is determined that the default information exists, acquiring the dynamic information collected by a second signal collecting device corresponding to the first signal collecting device generating fault, to replace the dynamic information acquired by the first signal collecting device generating fault; and positioning each default device according to the dynamic information acquired by the first signal collecting device or the second signal collecting device;

wherein each default device is provided with one first signal collecting device and the second signal collecting device corresponding to the first signal collecting device, the first signal collecting device and the second signal collecting device are both configured to collect the dynamic information of the default device where the first signal collecting device and the second signal collecting device are located in real time, mutual redundancy exists between the first signal collecting device and the second signal collecting device disposed on the same default device, the type of each default device is the same, and the mounting position of each default device in the turnout system is different.

16. The non-transitional computer readable storage medium according to claim 15, wherein the default devices are trolleys, and when the default devices are the trolleys, the dynamic information is the displacement information of the trolleys.

17. The non-transitional computer readable storage medium according to claim 16, wherein when the default devices are the trolleys, the acquiring the dynamic information, collected by each of the first signal collecting devices, of each of the default devices where the first signal collecting devices are located, and determining whether the first signal collecting devices include fault information or not according to the dynamic information comprises:

acquiring the displacement information, collected by the plurality of first signal collecting device, of the trolleys;

computing comparison information between the displacement information of two adjacent trolleys according to the displacement information; and comparing the comparison information with a predetermined threshold, and when the comparison information is greater than or equal to the predetermined threshold, and the trolley corresponding to the comparison information exceeding the predetermined threshold is in a normal operation state, determining whether the first signal collecting device disposed on the trolley corresponding to the comparison information exceeding the predetermined threshold includes the fault information or not.

18. The non-transitional computer readable storage medium according to claim 17, wherein the comparison information is a difference value or a specific value between the displacement information of two adjacent trolleys.

* * * * *